United States Patent [19]

Schaff

[11] Patent Number: 4,665,460

[45] Date of Patent: May 12, 1987

[54] DEVICE FOR PROTECTING OVERHEAD ELECTROCONDUCTING LINES AGAINST LIGHTNING

[76] Inventor: Jean-Paul Schaff, 18, Avenue des Tilleuls, F-19200 Ussel, France

[21] Appl. No.: 678,545

[22] PCT Filed: Mar. 2, 1984

[86] PCT No.: PCT/FR84/00049

§ 371 Date: Nov. 1, 1984

§ 102(e) Date: Nov. 1, 1984

[87] PCT Pub. No.: WO84/03594

PCT Pub. Date: Sep. 13, 1984

[30] Foreign Application Priority Data

| | | | |
|---|---|---|---|
| Mar. 3, 1983 | [FR] | France | 83 03795 |
| May 25, 1983 | [FR] | France | 83 08954 |
| Aug. 11, 1983 | [FR] | France | 83 13409 |

[51] Int. Cl.[4] ..... H01T 4/02

[52] U.S. Cl. ..... 361/137; 361/117; 339/14 R; 339/109; 343/845; 174/6; 174/78

[58] Field of Search ..... 361/12, 35, 39, 40, 361/117, 137; 339/14 R, 14 L, 108 R, 109; 343/829, 845; 174/6, 51, 78

[56] References Cited

U.S. PATENT DOCUMENTS

| | | | |
|---|---|---|---|
| 1,755,324 | 4/1930 | Jacobs | 361/132 |
| 1,769,101 | 7/1930 | Becker | 403/308 |
| 3,370,122 | 2/1968 | Ichikowa | 174/78 |
| 3,377,609 | 4/1968 | Shannon | 339/38 |

FOREIGN PATENT DOCUMENTS

| | | | |
|---|---|---|---|
| 424878 | 2/1926 | Fed. Rep. of Germany . | |
| 549548 | 4/1932 | Fed. Rep. of Germany . | |
| 558985 | 9/1932 | Fed. Rep. of Germany . | |
| 634692 | 1/1937 | Fed. Rep. of Germany . | |
| 718984 | 3/1942 | Fed. Rep. of Germany . | |
| 1490257 | 12/1968 | Fed. Rep. of Germany . | |
| 1185989 | 8/1959 | France . | |
| 1345207 | 12/1963 | France . | |
| 1464089 | 12/1966 | France . | |
| 2094512 | 2/1972 | France . | |
| 2282177 | 3/1976 | France . | |
| 2456401 | 5/1980 | France . | |
| 785925 | 12/1980 | U.S.S.R. | 174/6 |

OTHER PUBLICATIONS

"Optimum Design of Substation Grounding in a Two Layer Earth Structure" Part III by Dawalibi et al., IEEE Transactions on Power Apparatus and Systems vol. PAS-94, Mar./Apr. 1975.

*Primary Examiner*—A. D. Pellinen
*Assistant Examiner*—Derek S. Jennings
*Attorney, Agent, or Firm*—Michael Ebert

[57] ABSTRACT

A lightning protector for overhead electric lines comprises at least one of the following elements: a spark-arrester (111,112) a ground lead and a device for the connection of electric cables. Measures for reducing the impedance of the elements forming the circuit for the discharge to the ground of the shock wave due to atmospheric charges are proposed.

12 Claims, 28 Drawing Figures

101
106
105
104
103
107
102
108

101'
119
117
1,5m
129
124
116
114
123
112
111
113
118
102'
120

124
117
127
125
126
115
128
116
123
122
121
112

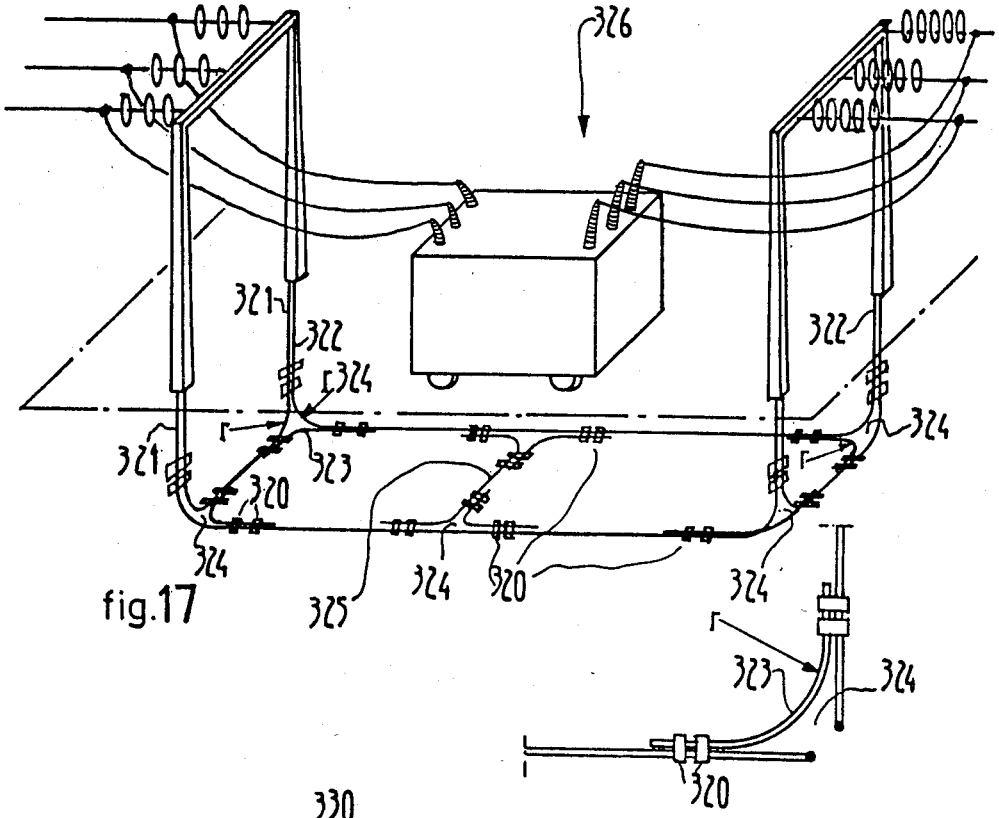
fig.17
fig.17a
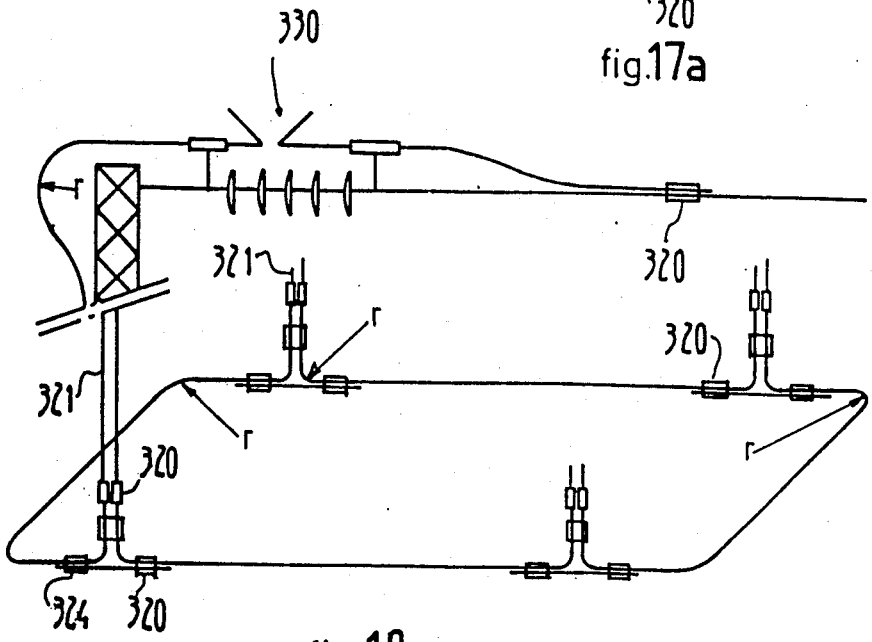
fig.18

DEVICE FOR PROTECTING OVERHEAD ELECTROCONDUCTING LINES AGAINST LIGHTNING

The present invention relates to the field of the transmission of electrical energy by overhead lines and more particularly improved means to protect such lines and installations which are electrically connected to them against lightning.

It is known that lightning may take place in the form of an electric discharge under very high voltage between the ground and, for instance, cloud masses, using preferably the electroconductive path offered by objects which are elevated above the ground such as trees, buildings and, of course, overhead electrical systems. It is known how to protect overhead electrical energy transmission systems by devices known as arresters, formed by a pair of electrodes each consisting of a galvanized steel rod bent to about 45°; the electrodes are arranged in the vicinity and generally directly above a group of insulators, a tower or a pole in the same plane, the bends thereof facing each other and being separated by a certain distance, one of the electrodes being connected to the electric line and the other being connected to the ground; one of the electrodes is supported via a crossbar directly by the line cable; the other electrode is also supported by a crossbar integral with a cable or rod for fastening the insulators to the poles; this fastening cable may also serve, since it is connected to the ground, as ground conductor for the second electrode; generally, the electrodes, their support crossbar and the fastening cable are of steel. The use of such a manner of protection in actual practice has shown that systems under voltage such as transformers, for instance, were protected in the case of discharges not exceeding 15 kilo-amperes; in the case of discharges of higher intensity, the grounding of the line by arresters of the present design is inadequate; a number of transformers and other apparatus forming part of the systems are thus damaged by lightning each year.

Furthermore, for a very long time devices have been known for the grounding of lightning protection means, these devices generally consisting of an electric conductor buried in the earth or, even better, extending into a shaft so as, by means of the underground water, to find in the earth an electroconductive mass having the lowest resistance possible. Now the ground connections proposed up to the present time, while they are entirely suitable for dissipating a continuous electric voltage, seem poorly suited to dissipating energy of an electric wave of very great amplitude and short period such as that with which the phenomenon of lightning generally takes place.

The basic idea of the present invention rests, on the one hand, on recent knowledge as to the nature and behavior of the current forming the discharge of the lightning in conductors and, on the other hand, on consideration of the fact, which has been known for a longer time, that electric charges distribute themselves on the surface of conductors. Studies carried out during the last decades have shown that an atmospheric discharge entailed a phase of increasing intensity (the discharge front) of about 8 microseconds and a phase of decreasing intensity (the discharge tail) of about 20 microseconds; it is this intensity wave which is propagated along the "discharge channel" and into the conductors encountered; thus, while the techniques of the prior art did not take this oscillatory, dynamic aspect of the discharge into account, the present invention is directed precisely at placing greater store in it, trying to reduce to a maximum the impedance of the ground evacuation circuits, in particular, by striving to preserve the surface or film conduction effect of these circuits.

Thus the improvements proposed by the invention relate to three kinds of means: First of all, the arresters and their manner of connection, secondly, the ground connections and their connection; and thirdly, connecting or junction means.

First of all, in accordance with the present invention, an arrester of the type comprising a pair of electrodes which are supported by a support which is rigidly connected with an insulator and are separted from each other, the said pair of electrodes being referred to as an arrester, one of the electrodes being connected to said line and the other electrode being connected to the ground, is primarily characterized by the fact that the said electrode support has the general shape of a T formed of a transverse portion and a stem, by the fact that at least the said transverse portion has substantially circular symmetry around a longitudinal axis, and by the fact that it is provided at each of its ends with an axial clamping means intended to make it fast, on the one hand, to the said electrode and, on the other hand, to a cable or electro conductive rod, and by the fact that at least the said transverse portion and its clamping means are made of a non-magnetic electroconductive metal.

It results from such an overall design of the arrester, on the one hand, that the film circulation of the electric charges is favored to the utmost and that the impedance, and therefore the induction phenomena which are specific to the wave current of the lightning, are reduced to a minimum.

For reasons of convenience in mounting and adjustment, it is recommended that the electrode supports be themselves formed of several parts; it will be noted, still in view of the undulatory short wavelength aspect of the discharge, that the surface/surface contacts are not to be feared; the composite nature of the electrode supports has advantages in the operations of setting up and adjustment.

In accordance with a first embodiment, the transverse portion of the electrode holder is a cylindrical part having at one of its ends a chuck of the push-out collet type intended to surround the end of the electrode while its other end has a multi-strand cable connecting member with inner conical surface and axially bored conical core intended to surround the end of a multi-strand conductor of the discharge evacuation circuit.

In accordance with a second embodiment, the transverse part of the electrode support is a cylindrical part provided at each of its ends with two push-out collet chucks, one of the chucks surrounding the said electrode and the other chuck surrounding a straight conductive rod of the same diameter as the electrode, the end of said rod being itself clamped in a push-out collet chuck of a connector the other end of which has a multi-strand cable connection clamping member with inner conical surface and conical core bored axially to surround the end of a multi-strand conductor of the discharge evacuation circuit.

In accordance with a preferred embodiment of the electrode-holder stem, it consists of an upper portion comprising an axially bored ring to surround the said transverse portion, said ring being connected to a rod, a connecting part forming a double push-out collet mandrel and a lower rod rigidly connected with an insulator; one end of the upper rod is clamped in a collet of the chuck of the connecting part, while one end of the lower rod is clamped in the collet of the other chuck of this same part.

In accordance with another secondary feature of the invention, and, noting that it will serve no purpose to lower the impedance of the electrode supports if the other portions of the evacuation circuit are of high impedance, the present invention proposes arranging the other elements of this circuit in such a manner that they are as linear as possible, or that at most their curvature is of large radius and at least no element of this circuit has a retrogression point, but rather connect wtih each other tangentially.

Thus, the cable connecting the first electrode to the electroconductive line is connected tangentially, at a point of connection, while the cable which connects the second electrode to the ground has in the vicinity of the pole a radius of about 50 cm.

Secondly, still in accordance with the present invention, a ground connector intended for the grounding of heavy overloads, such as caused by lightning, of overhead electric lines, the said ground connection being of the type consisting of an electric conductor buried in the earth, is characterized, in general, by the fact that the said conductor which is buried in the earth is a single conductor closed on itself at a looping point so as to form a loop and by the fact that the grounding conductor coming from the overhead system is connected tangentially to said loop at at least one point of connection.

The looping on itself of the buried conductor is preferably effected by means of a device consisting of a double chuck with coaxial collets and conical surfaces, while the tangential connection to the loop of the grounding conductor is effected by means of a rider.

The connection of the grounding conductor preferably comprises, furthermore, a third conductor element connected tangentially at each of its ends, on the one hand, to the said grounding conductor and, on the other hand, to the looped conductor, the connection of the latter to the loop being effected in a tangential direction opposite that of the said connection, the grounding conductor, the conductor of the loop of the third connecting conductor forming a sort of triangle, known as a connection "equipotential triangle," the sides of this triangle being, in fact, substantially circular arcs.

Said loop preferably has the general shape of a rectangle with corners rounded along substantially circular arcs.

Finally, one of the sides of the "equipotential triangle" is preferably one of the rounded corners of said loop.

Thirdly, still in accordance with the present invention, an electric junction device for electroconductive cables is characterized, in general, by the fact that it incorporates at least one part of elongated shape curved on itself in the direction of its width so as to form, by itself alone or in combination with another similar part, a sleeve intended to completely surround two electric cables which are parallel to each other in said sleeve, the said part being formed of a non-magnetic electroconductive metal; the two adjacent shell edges are advantageously pressed against each other in close electrical contact.

It results from these arrangements that the junction thus formed is of very low impedance with respect to electric discharges of the type of those of lightning or induced by it.

Preferably, the aforementioned shell or shells are stopped by suitable means around conductors, these means being arranged in the vicinity at least of each of the ends of the shell.

A junction device according to the invention preferably furthermore incorporates a part, known as the contact part, which has a double-cradle profile and a length substantially equal to that of a shell, the radius of curvature of a cradle being substantially equal to the radius of a conductor.

A junction device in accordance with the present invention will find use in the side-by-side junction of electric conductors as such junctions appear in the aforementioned patent applications, particularly when there is concerned the "grounding" of an anti-lightning installation and in particular when the ground connection of such installations is formed of several electric conductors buried in the earth; in this case, the conductors buried in the earth are connected to each other by electroconductive segments which are themselves buried, the junction of a segment with a conductor being effected by means of said device.

Applied to the case in which two grounding conductors penetrate into the earth in the vicinity of each other, these two conductors are connected, on the one hand, by at least one device such as described above and, on the other hand, by an electroconductive segment, the electroconductive segment and the said conductors forming underground a connection triangle known as an equipotential triangle.

The present invention will be better understood and details thereof will become evident from the description which will be given, on the one hand, briefly of the technique of the prior art and, on the other hand, of preferred embodiments in accordance with the technique of the invention, read with reference to the figures appearing in the accompanying drawings, in which.

Figure 7:
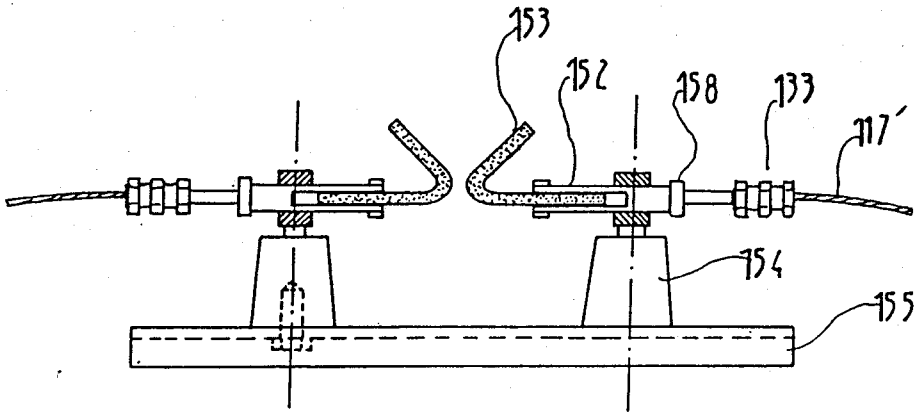
Figure 7B:
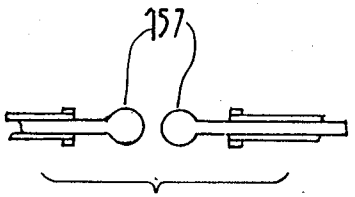
Figure 7A:
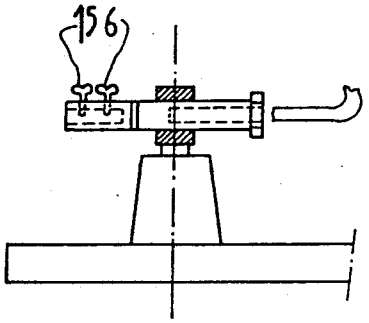
Figures 8, 8A, 8B, 8C:
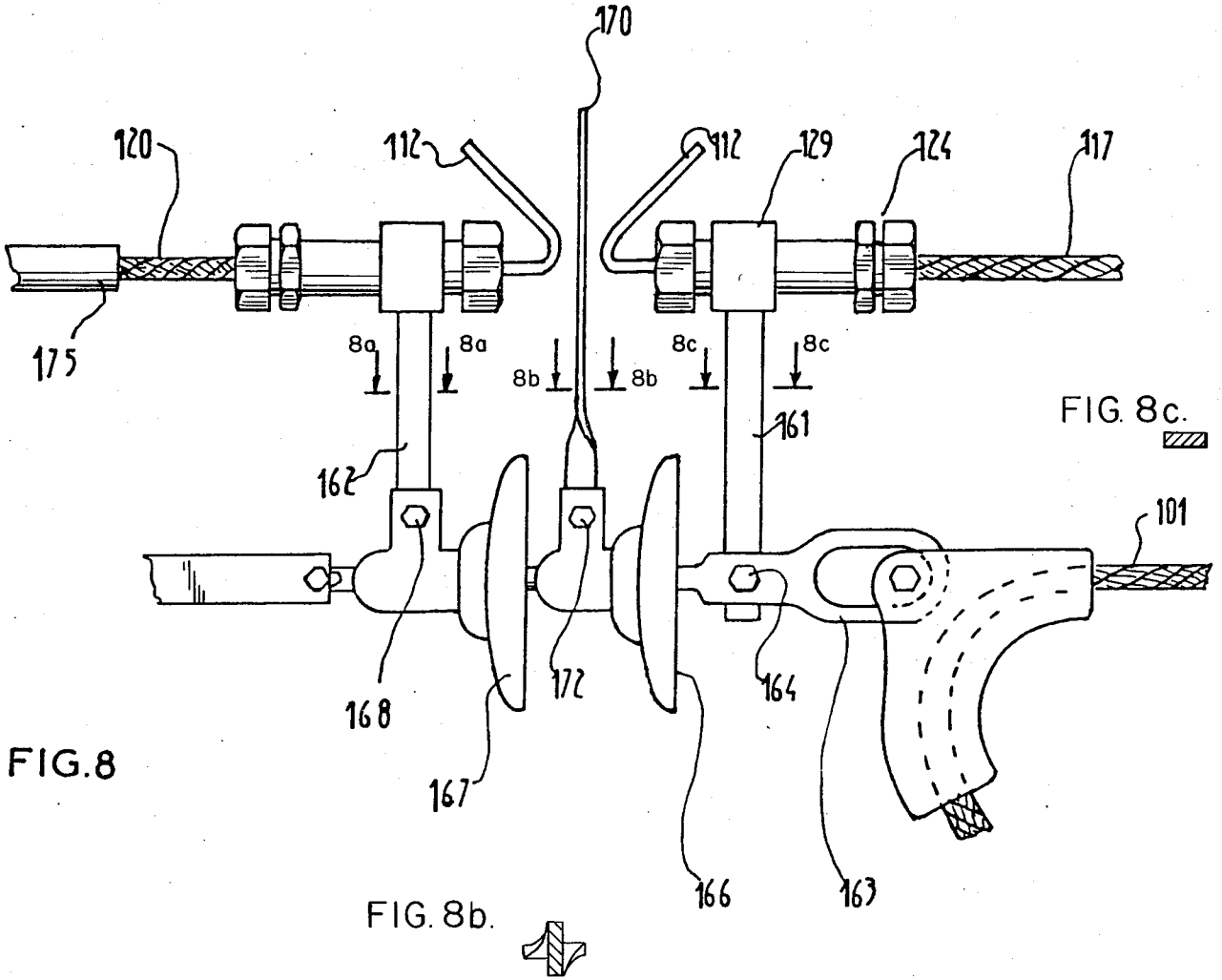
Figure 9:
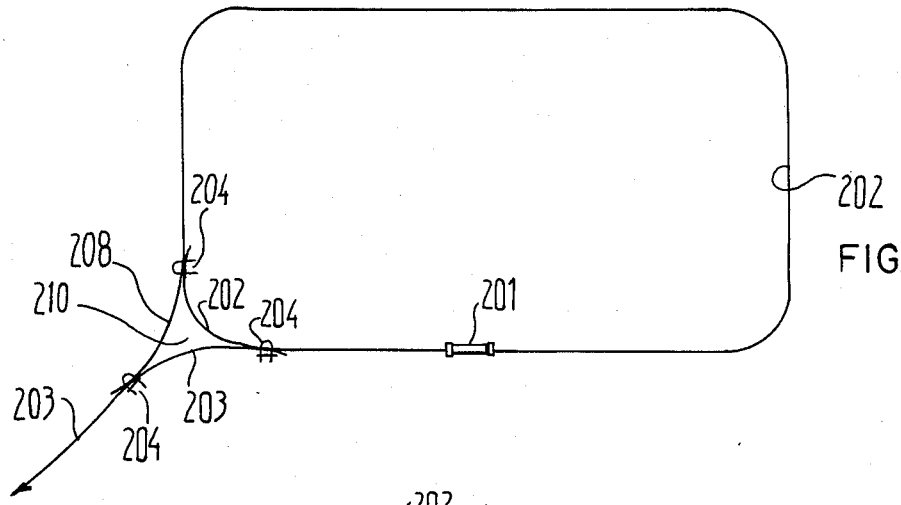
Figure 10:
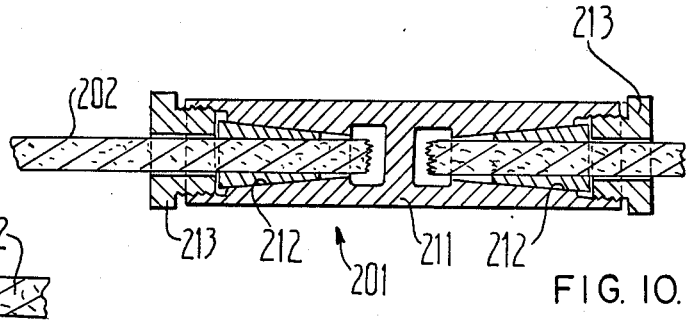
Figure 11:
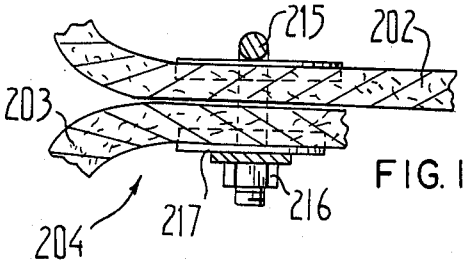
Figure 12:
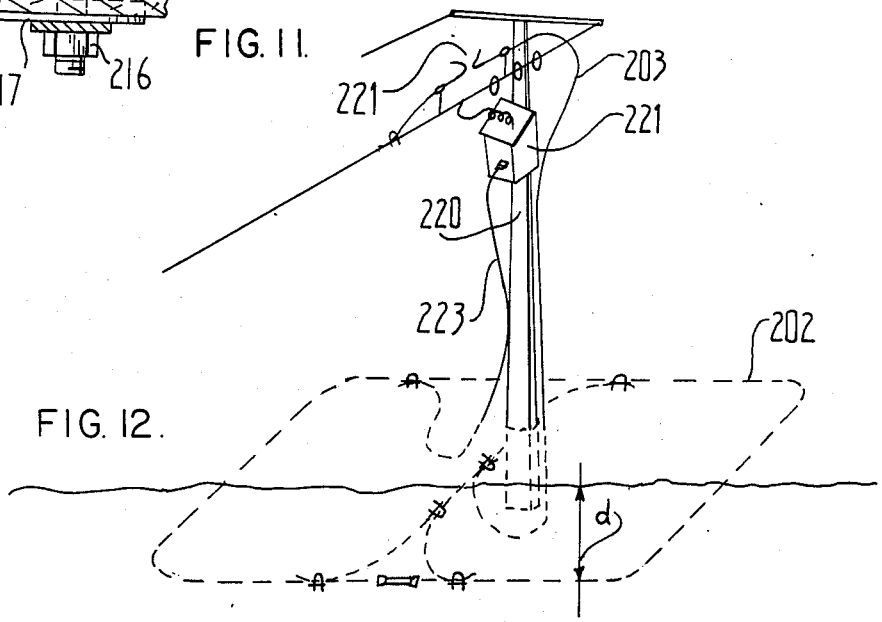
Figure 19A:
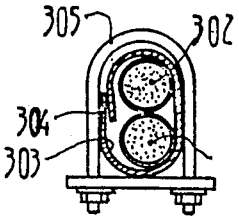
Figure 19:
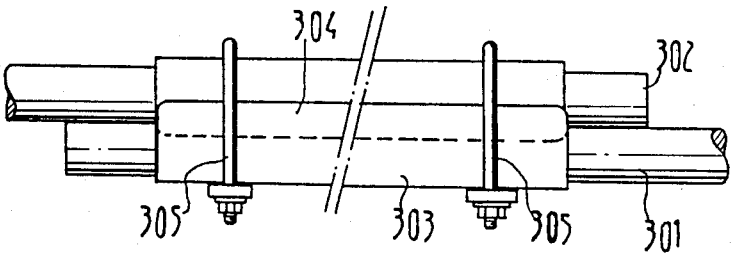
Figure 20A:
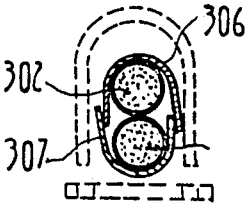
Figure 20:
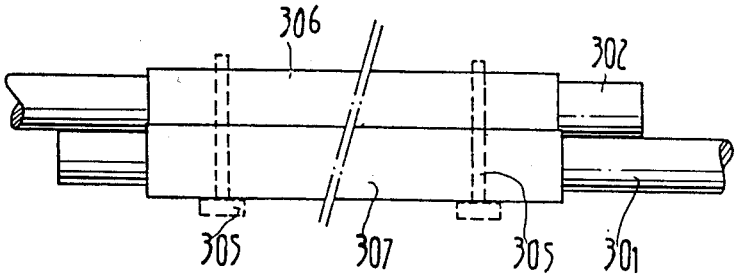
Figure 21:
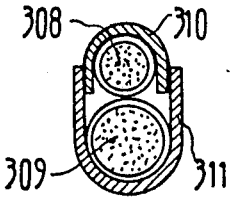

FIGS. 7, 7*a*, 7*b* illustrate an arrester for low voltage (LV);

FIG. 8 illustrates an embodiment of the support stems;

FIG. 9 is a simplified diagrammatic illustration of a ground connection in accordance with the invention;

FIG. 10 is a detail view in cross section of the previous figure;

FIG. 11 is a detail view in cross section of FIG. 9;

FIG. 12 is an illustration in perspective of an application to a line terminal of a ground connection such as that shown in FIG. 9;

FIGS. 13 to 16 illustrate, in a manner similar to FIG. 9, more complicated special cases of the embodiment of a ground connection in accordance with the invention;

FIG. 17 illustrates a transformer station comprising a ground connection in accordance with the invention;

FIG. 17*a* is a detail view on a larger scale of the preceding figure;

FIG. 18 illustrates the grounding of a mast according to the invention using the devices covered by it;

FIG. 19 is a front and side view of a single-piece junction device of the invention;

FIG. 20 is a similar illustration of a two-shell junction device;

FIG. 21 is an end view of a junction of conductors of different size, and

Figure 22:
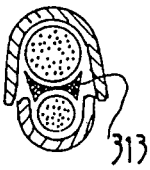
Figure 22A:
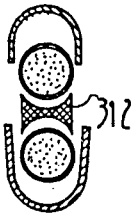

FIGS. 22 and 22*a* illustrate junction devices incorporating an intermediate contact part.

Figures 1, 2, 3:
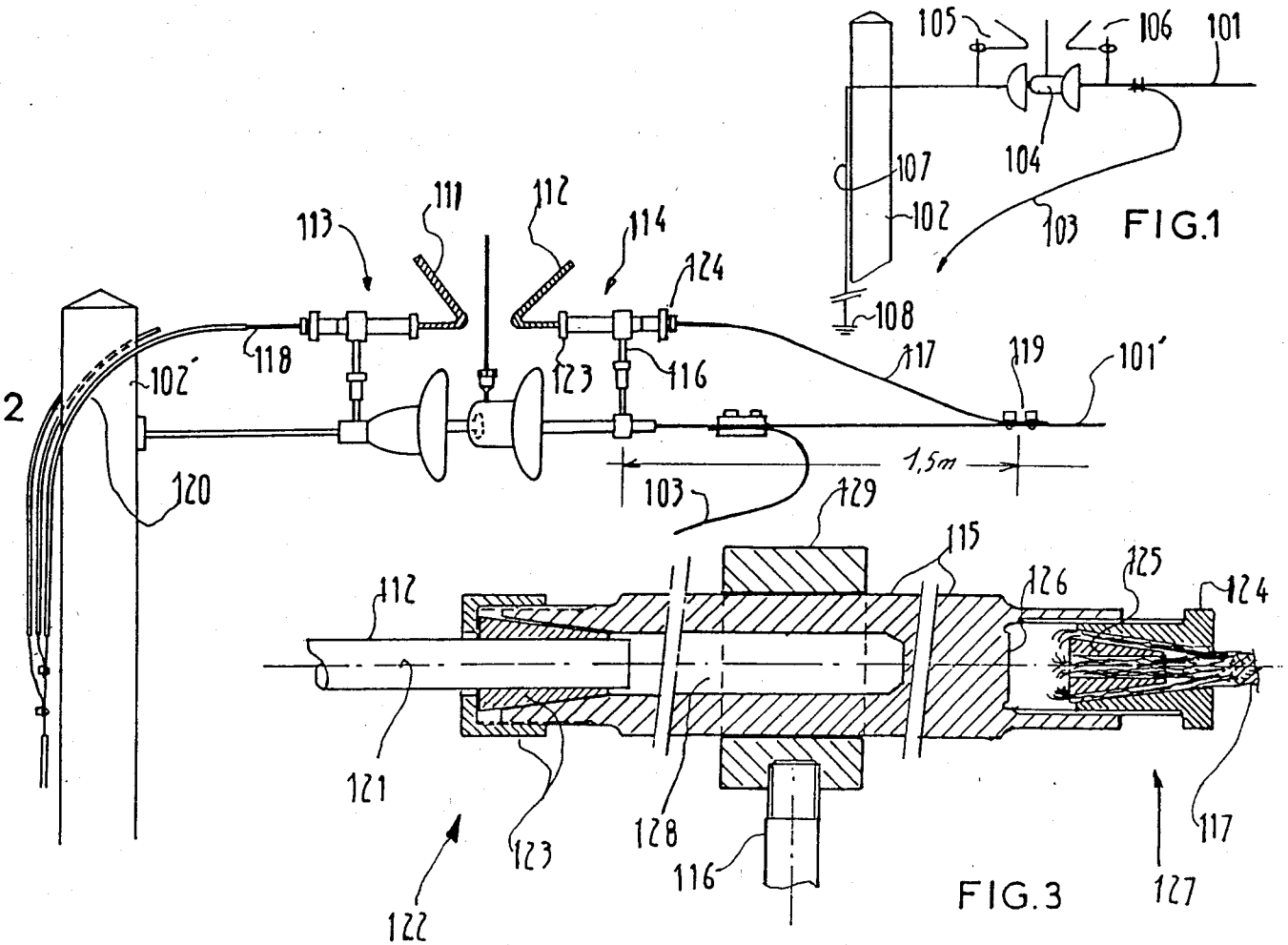
FIG. 1 is a diagrammatic illustration of a tyical mounting of the prior art.
FIG. 2 is an illustration of an anti-lightning protection device according to the invention.
FIG. 3 is a detail view in cross section on a larger scale of a member of the preceding figure.

Referring to FIG. 1, by way of illustration of the prior art in this field a medium-voltage electroconductive line stop 101, for instance, comprises a mast 102, a connection 103 to the subsequent installations, an insulator assembly 104 and an anti-lightning protective device, itself comprising a pair of electrodes 105 and 106 and an evacuation conduit 107 towards a ground connection 108; subsidiarily, an "anti-bird" rod is arranged between the electrodes in order to avoid the electrocution of those animals. It will be noted that the connection of each electrode via its support comprises at least two right angles; it is noted that the stem of the electrode serves as conductor and that, in general, the electrode is connected to its stem by means of an eyehole and a bolting through the eyehole; in general, furthermore, both the electrode and its support stem are made of galvanized iron. This device for the protection of the subsequent installation from the effects of lightning, known as an arrester, is, in general, as has been stated above, ineffective for discharges in excess of 15 kA and it is fully representative of the known prior art.

In FIG. 2, which shows an improved arrester in accordance with the invention, electrodes 111 and 112 for instance of copper, are supported by supports 113 and 114 respectively, having in general a T shape; each support such as the support 114 is formed of a transverse portion 115 and a stem 116. The particular structure of these supports will be described further below, but it should be noted here that the transverse portion has a generally cylindrical shape, along the axis of which there are connectd the electrode 112, on the one hand, and the cable 117 connecting this first electrode to the electroconductive or discharge shunting line; it will be noted that the same is true with regard to the other electrode with the cable 118 connecting the second electrode to the ground.

It will also be evident from the figures that, in accordance with what is recommended by the present invention, the cable 117 is connected tangentially to the line 101' at a point 119 which is at least 1.50 meters from the arrester and that the cable, which is insulated for a minimum of 1000 volts, which connects the second electrode to the ground, has, in the vicinity of the mast 102', a curvature 120 of rather large radius (on the order of 50 cm for example).

FIG. 3 shows in cross section, on a larger scale and in greater detail, an electrode holder such as the electrode holder 114 of the preceding figure; this electrode holder is essentially formed of a transverse portion 115 and a stem 116; the transverse portion 115 is a substantially cylindrical part or else a part symmetrical with respect to the axis 121; at one of its ends 122 it has a chuck 123 of the push-out collet type surrounding the end of the electrode 112; and its other end 127 it has a connecting member for the multi-strand cable 117 comprising a nut 124 with conical inner surface and conical core 125 which is bored axially; this type of connection of the multi-strand cables is known per se and it will be recalled that the tightening of the nut 124 brings the inner end of the core and the clamped strands in contact with the end stop 126. The push-out collet chuck of the end 122 is also known per se; it will be noted, however, that the cylindrical part or transverse portion 115 is provided with an inner bore 128 which is sufficiently deep to permit the electrode to engage to a greater or lesser extent therein.

In accordance with the invention, the component parts of the transverse portion are formed of one or more non-magnetic metals, or else non-ferromagnetic metals such as copper, brass, bronze, aluminum or the like, to the exclusion of metals having ferromagnetic properties.

The stem 116 is connected to the transverse portion 115 by an axially bored ring 129.

Figure 4:
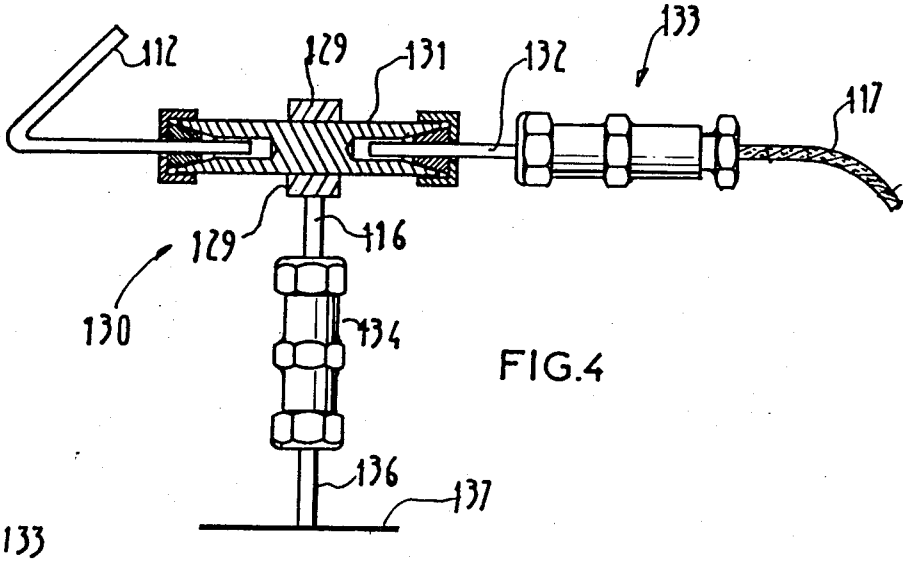
FIGS. 4 are illustrations of other embodiments.
Figure 5A:
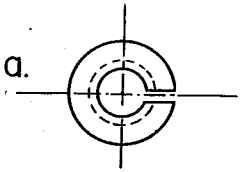
FIG. 5 is a similar illustration of another variant and FIG. 5*a* is a cross section in detail thereof.
Figure 5:
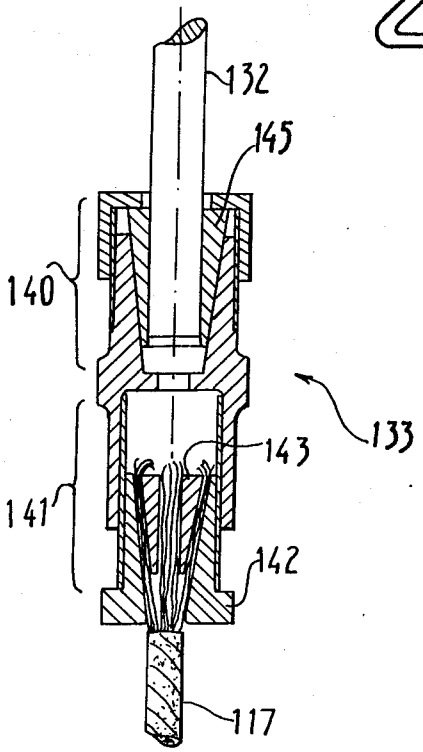

In FIG. 4, an electrode support 130 is formed of a transverse part 131 provided at each of its ends with two push-out collet chucks similar to the push-out collet chucks 123 of the preceding figure; one of the chucks serves to clamp the electrode 112 while the other chuck clamps a rod 132 which, in its turn, is connected to the multi-strand conductor 117 via a connector 133 having substantially the same functional structure as the transverse part of the preceding figure; this connector is illustrated in greater detail in FIGS. 5 and 5*a*. The stem of the electrode support 130 is formed of an upper portion formed by a rod 116 and by a ring 129 which is bored axially in order to surround the transverse portion 131 of a connecting part 134 forming two push-out collet chucks and of a rod 136 which is rigidly connected with an insulator portion 137 at one of its ends, its other end being engaged in one of the chucks of the part 134. The advantage of this assembly with intermediate part 134 is that it permits easy adjustment in height and orientation of the electrode 112.

Figure 4A:
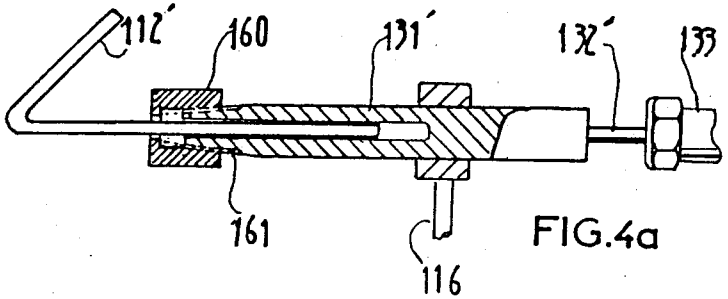

In FIG. 4*a*, a variant mounting of the arrester differs from the preceding one in that the transverse part 131' comprises at one of its ends a necked-down portion 132' similar to the part 132 and at its other end an axial clamping chuck formed by a nut 160 with conical inner tapping and by an outer thread 161, itself conical, of the end of the transverse part 131; said threaded end has several longitudinal slits which, upon the tightening of the nut, permit the clamping of the electrode 112'. The other portions of this electrode mounting are similar to those of the preceding figure.

In FIGS. 5 and 5*a* the connecting part 133 of the preceding figure is formed, with respect to a first portion 140, by a push-out collet chuck and, with respect to a second portion 141, by a multi-strand cable connection member comprising a nut 142 with conical inner surface and axially bored conical core 143; this connecting member is entirely similar in itself to that formed by the part 127 of the transverse part of FIG. 3.

It will be noted that the connecting part 134 of FIG. 4 is formed of two portions 140 of the part of FIG. 3.

It will be noted that the connecting part 134 of FIG. 4 is formed of two portions 140 of the part shown in FIG. 3.

FIG. 5*a* recalls that a push-out collet such as the collet 145 of FIG. 5 is an axially bored conical part split along a generatrix.

Figure 6:
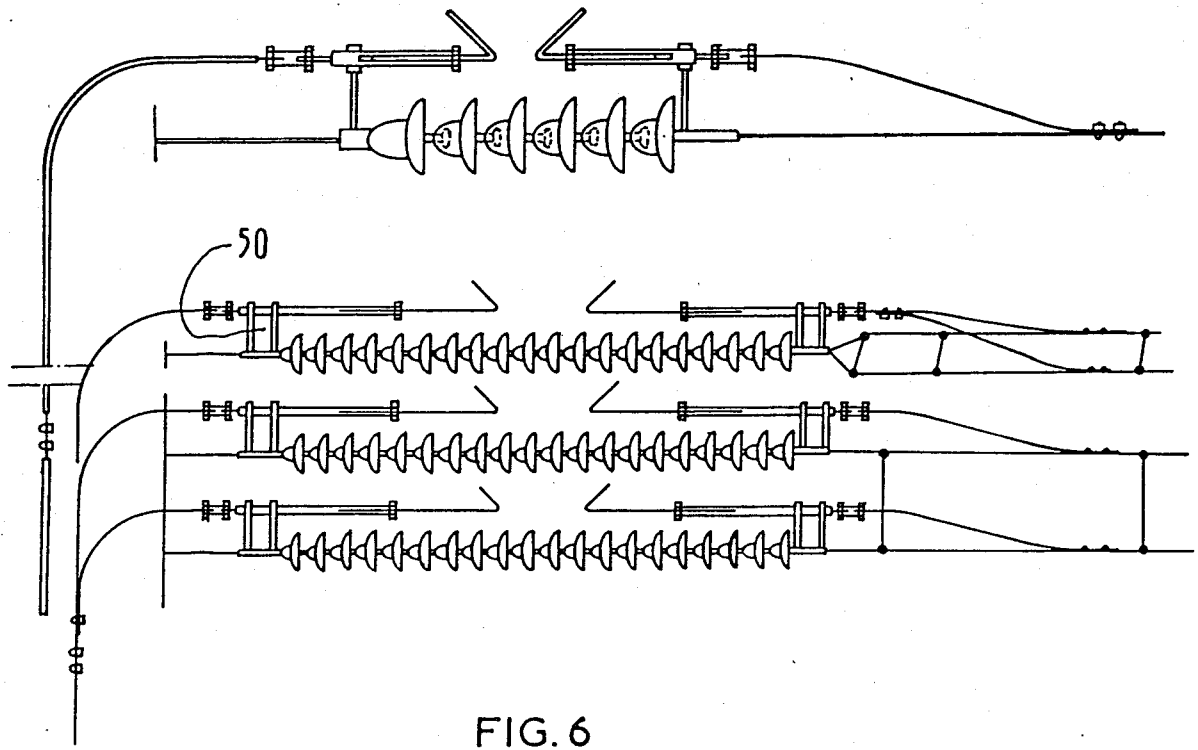
FIG. 6 illustrates various applications for MV, HV and VHV applications.

In FIG. 6 various examples of the use of the device of the invention are illustrated as applied to different lines. It will be noted that the electrode support stem can be doubled, as is true in the case of a stem 150, for instance, which is applied for the anti-lightning protection of a very high voltage line, in view of the great length of the insulator line.

In FIGS. 7 and 7*a* an arrester also applies the principles of the invention in that the electrode support is formed of a transverse part such as 152 axially clamping an electrode 153 and connected, still axially, to the conductor 117'. Stems such as 154 are made of an insulating material such as porcelain and are fastened on a support plate 155 which may be of aluminum. The connection of the electrodes to the multi-strand cable 117' is effected, for instance, via a part 133 similar to that of FIG. 4 and by an end chuck 158 of the transverse part 152. In FIG. 7*a*, the chuck 154 of the preceding figure is replaced by a transverse screw clamping 156.

FIG. 7*b* shows a variant embodiment of FIG. 7 in which the electrodes 153 of the preceding figure are replaced by electrodes with spheres 157. Such sphere electrodes, which are slightly more expensive than the horn electrodes described up to now, may also be provided on all of the arresters previously described and be substituted for the horn electrodes; sphere electrodes are, in principle, slightly more effective than horn electrodes, but it will be noted that this increase in effectiveness is entirely minimal as compared with that provided by the mounting of the electrodes, whatever they are, which are recommended by the invention.

In FIG. 8, there is shown a mounting of anti-lightning arresters in accordance with the invention which is rather similar to that shown in FIGS. 2 to 4 (equivalent parts are provided with the same reference numbers); it will be noted, however, that in this figure the arrester support stems such as 161 and 162 are bars or flats of rectangular cross section, which are also respectively shown in FIG. 8*c* (Section taken along 8*c*—8*c* of 161) and FIG. 8*a* (Section taken along 8*a*—8*a* of 162); the lower portion of the stem 161 is connected by means of a bolt 164 to member 165 connecting the line 101 to a first insulator 166 while the lower portion of the stem 162 is fastened to a second insulator 167 by a bolt 168.

It will also be noted from this figure that an anti-bird device 170 is also formed by a flat the rectangular section of which is shown in FIG. 8*b* (Section taken along 8*b*—8*b* of 170) which flat is twisted a quarter of a turn in the vicinity of its lower portion in order to be fastened via a bolt 172 on the connecting portion of two adjacent insulators 166 and 167.

There will also be noted in this figure the insulating sheath 175 of the cable 120, which is an insulation sheath of at least 1000 volts.

In FIG. 9 a single electric conductor is closed on itself to form a loop 202 by a looping device 201; the loop has a substantially rectangular shape the straight portions of which have lengths greater than one meter and preferably of at least 5 meters; the conductor is a bare copper cable of a cross section of 25 to 150 $mm^2$; the sides of the loop are connected to each other along curved portions of a radius of about 0.5 meter.

A grounding conductor 203 of, for instance, arresters or anti-lightning devices of variable resistance of the overhead system is an electric conductor having the same characteristics as the conductor of the loop 202 but it is preferably insulated at least on its overhead portion; this grounding conductor is connected tangentially once to the loop 202 at a first point of connection 204 by means of a connecting device; it is again connected a second time tangentially to the loop at a second point of connection 204 by means of a third conductor 208, which, in its turn, is connected tangentially at each of its ends to the conductor 203 and to the loop 202 at a third point of connection 204; the first and second points of connection 204 on the loop have opposite tangential directions; the conductors 202, 203 and 208 are curved in the vicinity of their point of connection and they form a sort of triangle 210, called an equipotential triangle; the curved sides of this triangle are substantially circular arcs having a radius of about 0.5 meter; the third conductor 208 is, of course, similar to the other conductors of the ground.

In FIG. 10, the looping device 201 is formed of a double chuck with coaxial conical surfaces and collets, known per se in connectors for electrical conductors; in the application made of it in the present invention, the component elements, namely body 211, collet 212 and nuts 213 are of non-magnetic metal, preferably of bronze.

In FIG. 11, a connecting device 204 is formed by a rider 215 with two nuts 216 and safety washer 217, which is also of known type, the component elements of which are developed, in accordance with the invention, of non-magnetic metal.

FIG. 12 shows diagrammatically a line-end mast 220 comprising a transformer station 221 and lightning protection means consisting of an arrester 222 grounded by an insulated conductor 203; the loop 202, which is located at a distance of about 1 or 2 meters below the surface of the earth and around the base of the mast, is, for instance, similar to the one shown in FIG. 16; there will also be noted a conductor 223 for grounding the mass of the overhead system and/or the neutral of the network; this conductor 223 is in its turn connected tangentially to the loop 202.

Figure 13:
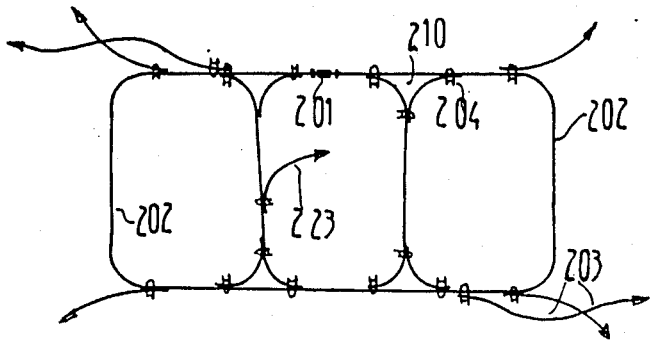
Figure 14:
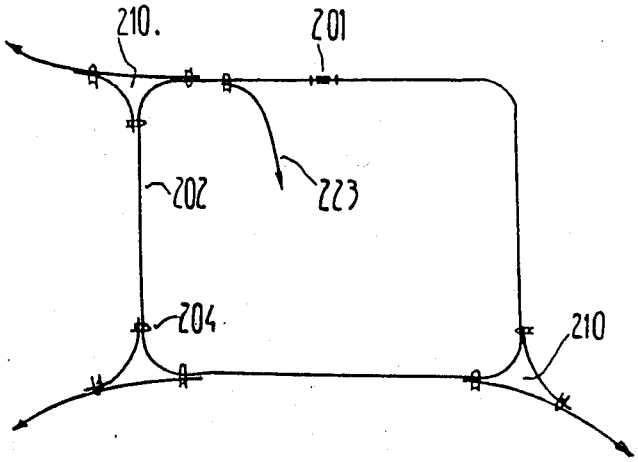
Figure 15:
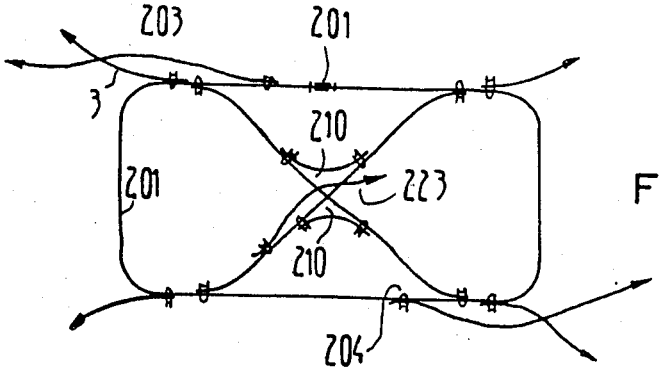
Figure 16:
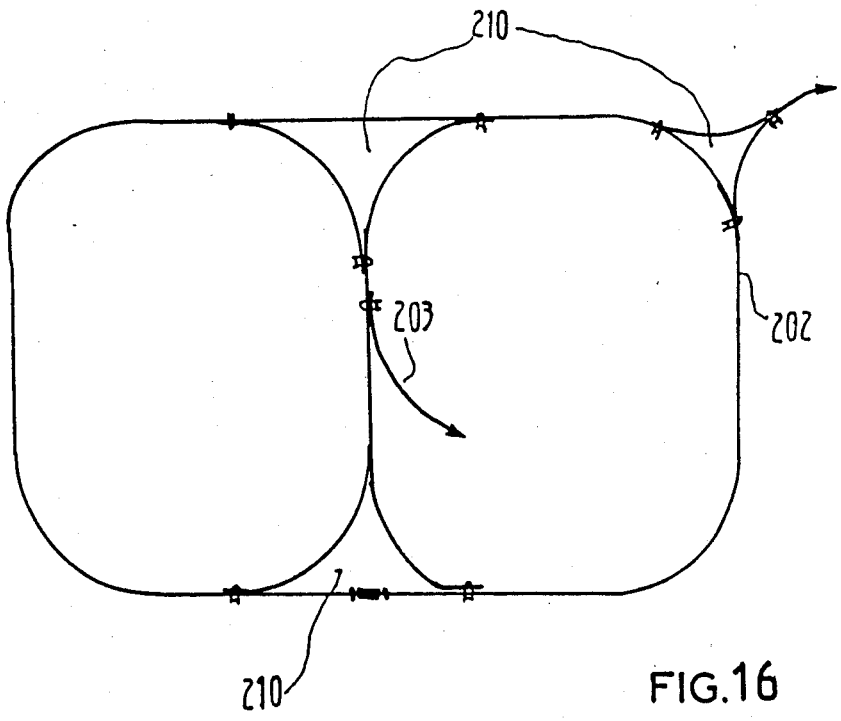

In FIGS. 13, 14, 15, and 16, ground connections have a structure and/or geometry which is substantially different from the ground connection of FIG. 9; these ground connections are intended for overhead installations larger than a single mast; for instance, the ground connections of FIGS. 13, 14, and 15 can be used for the grounding of transformer installations, while the ground connection of FIG. 16 will be suitable, for instance, for a high-voltage line mast. It will be noted that the higher the overhead installation, the bigger the loop 202 must be; for optimum protection, the dimensions of the loop will preferably be greater than the largest dimension of the installation protected, and the loop will preferably surround the trace of the installation on the ground. It will be noted, however, that these ground connections are suitable in general for all high, medium and low-voltage installation. There can be noted in their structure the elements referred to in the description of the grounding of FIG. 9, namely a looping member 201, one or more single-conductor loops 202, equipotential connection triangles 210, connecting parts such as 204 and various grounding conductors such as 203 and 223.

Finally, from all of FIGS. 9 to 16 the tangential and/or coaxial connection of the conductors will be noted; by coaxial connection of the conductor there is understood the connection of the conductor in the extension of itself, this essential characteristic of the invention having the effect of decreasing the impedance of the conductors with respect to the electric wave of the lightning.

In FIG. 17, which illustrates diagrammatically a transformer station 326 of HV/MV or VHV/HV type, the devices of the preceding figures are indicated symbolically by small rectangles 320 bridging two cables side by side. It will be noted from this figure that the conductors such as 321 and 322 for the grounding of the overhead anti-lightning installation do not have any mechanical interruption in the portion thereof which is buried in the earth; it will also be noted that in the earth they are connected due to junction devices by a segment such as 323 to form connection triangles 324, so-called equipotential triangles; finally, it will be noted that the portion buried in the earth having the general shape of a rectangle, a conductor 325, referred to as internal bridge conductor, connects the sides of the rectangle in the vicinity of their center.

In FIG. 18 it is recalled that a ground connection of the type shown in the preceding figure may be advantageously combined with arresters such as the arrester 330, called a high flow power arrester, as they are defined in the first patent application cited above.

In FIGS. 17 and 18 there will be found the same parts as those mentioned in connection with the following figures bearing the same references. It will be noted that the radii of curvature r of the conductors, both overhead and buried, are at least 0.5 meter.

In FIG. 19, a device for joining the conductors of the two parallel electric cables 301 and 302 is formed essentially of an elongated part 303 which is curved on itself to form a sleeve surrounding the conductors; it is characterized by the fact that the two adjacent edges of the shells are pressed against each other along a close electric contact surface 304; straps 305 are arranged in the vicinity of the ends of the shell 303 FIG. 19*a* is an end view of FIG. 19.

In FIG. 20, the sleeve surrounding the cables 301 and 302 is formed by a pair of identical shells 306 and 307 whose longitudinal edges are maintained in close electric contact by means of straps 305 FIG. 20*a* is an end view of FIG. 20.

In FIG. 21 the electrical junction of conductors 308 and 309 of different diameters is assured by shells 310 and 311 which themselves have different radii of curvature so as to snugly fit the surface of the conductors.

FIGS. 22 and 22*a* show electric junction devices similar to those of the preceding figures but differing, however, by the presence between the conductors of contact pieces 312 or 313 having a double-cradle profile; these contact pieces, as well as the straps, are made of a non-magnetic metal or alloy which is a good conductor of electricity.

Although several elements (arrester, ground connection and connecting device) of the present invention have been shown in one or more embodiments, it is to be understood that the scope of this invention is not limited to these elements by themselves or in combination or the embodiment thereof which has been shown or described, but extends to all lightning protection devices as well as electrical systems using the latter which comprise the general features set forth above in order to decrease to the utmost the impedance of the over-voltage evacuation circuits, in particular by favoring to the maximum the effect of pedicular conduction.

I claim:

1. In an overhead transmission line arrangement in which a line conveying electrical power terminates at one end of an insulator whose other end is linked to a mast anchored in the ground, a lightning protector for the line comprising:

(A) a ground connection buried in the ground;

(B) first and second electrodes in spaced relation mounted above the insulator by first and second supports each including a conductive transverse section having an input and an output, the first and second electrodes being respectively secured to and projecting from the inputs of the sections of the first and second supports, said electrodes and said transverse sections being formed of non-magnetic metal to provide a very low impedance path with respect to electric discharges of the type produced by lightning;

(C) a first cable connecting the output of the first transverse section to the line at a connection point thereon displaced from the one end of the insulator; and (D) a second cable connecting the output of the second transverse section to said ground connection.

2. In an arrangement as set forth in claim 1, wherein each support has a T-shape constituted by said transverse section and a stem at right angles thereto, the stem of the first support being secured to one end of the insulator and that of the second support to the other end thereof.

3. In an arrangement as set forth in claim 2, wherein the first cable is connected tangentially to said connection point and the second cable has a curvature whose radius is about 50 cm in the vicinity of the mast, whereby said cables form very low impedance paths for the electric discharges carried thereby.

4. In an arrangement as set forth in claim 1, wherein each transverse section has a substantially circular symmetry around its longitudinal axis, and said input and output of said sections are provided with clamping means to engage the electrode and the cable associated therewith.

5. In an arrangement as set forth in claim 4, wherein said clamping means are constituted by a chuck of the push-out collet type.

6. In an arrangement as set forth in claim 2, wherein said stem is constituted by an axially-bored ring that surrounds the related transverse sections of the support, the ring being connected to a rod coupled to the insulator.

7. In an arrangement as set forth in claim 2, wherein said stem is constituted by an axially-bored ring that surrounds the related transverse section of the support, the ring being connected to a rod having a rectangular cross section that is bolted to the insulator.

8. In an arrangement as set forth in claim 1, further including an anti-bird device disposed in the space between the electrodes, the device being constituted by a rod having a rectangular cross section that is twisted a quarter of a turn on itself and bolted to the insulator.

9. In an arrangement as set forth in claim 1, wherein said ground connection is constituted by a conductor in a closed loop form, the second cable being connected tangentially to the loop.

10. In an arrangement as set forth in claim 9, further including a wire tangentially connecting the second cable to the loop in a direction opposite to that of the tangential connection of the second cable to the loop, the two tangential connections forming an equi-potential triangle.

11. In an arrangement as set forth in claim 9, wherein said loop has a generally rectangular formation.

12. In an arrangement as set forth in claim 9, wherein the dimensions of the loop are at least equal to the longest dimension of the overhead protector.

* * * * *